US008220523B2

(12) United States Patent
Morgott et al.

(10) Patent No.: US 8,220,523 B2
(45) Date of Patent: Jul. 17, 2012

(54) METHOD AND APPARATUS FOR MANIPULATING INVESTMENT CASTING MOLD HANDLERS

(75) Inventors: Anthony F. Morgott, Farmington Hills, MI (US); Mark J. Jordan, South Lyon, MI (US)

(73) Assignee: Anderson & Associates, Wixom, MI (US)

( * ) Notice: Subject to any disclaimer, the term of this patent is extended or adjusted under 35 U.S.C. 154(b) by 0 days.

(21) Appl. No.: 12/883,383

(22) Filed: Sep. 16, 2010

(65) Prior Publication Data

US 2012/0067539 A1 Mar. 22, 2012

(51) Int. Cl.
*B22C 19/04* (2006.01)
*B22C 25/00* (2006.01)

(52) U.S. Cl. ..... 164/154.1; 164/166; 164/323

(58) Field of Classification Search ..... 164/18–21, 164/165, 166, 322–323, 154.1, 456
See application file for complete search history.

(56) References Cited

U.S. PATENT DOCUMENTS

| | | | |
|---|---|---|---|
| 4,213,495 | A | 7/1980 | Rose |
| 4,463,796 | A | 8/1984 | Korshunov et al. |
| 4,589,467 | A | 5/1986 | Hunter |
| 4,832,105 | A | 5/1989 | Nagan et al. |
| 6,422,296 | B1 | 7/2002 | Pohlandt et al. |
| 6,637,497 | B2 | 10/2003 | Herron |
| 6,802,459 | B2 | 10/2004 | Renkl et al. |
| 7,479,247 | B2 | 1/2009 | Joyner |
| 7,490,710 | B1 | 2/2009 | Weskamp et al. |
| 7,588,070 | B2 | 9/2009 | Smetan |

*Primary Examiner* — Kuang Lin

(74) *Attorney, Agent, or Firm* — Harness, Dickey & Pierce, PLC

(57) ABSTRACT

An investment casting system includes a computer controlled mold transfer device movable between at least three stations, including a mold receiving station. A mold transfer station includes a mold suspended from a first horizontally extending arm of the mold transfer device engaging an intermediate transfer device to transfer the mold to the intermediate transfer device. A storage station has a storage rack receiving the mold following a material coating phase. A robot in communication with the intermediate transfer device is programmed to position the mold in any of multiple material coating stations during the material coating phase. The mold is accessible for removal from the system at any stage of completion by direction of a computer control system.

11 Claims, 13 Drawing Sheets

FIG 12
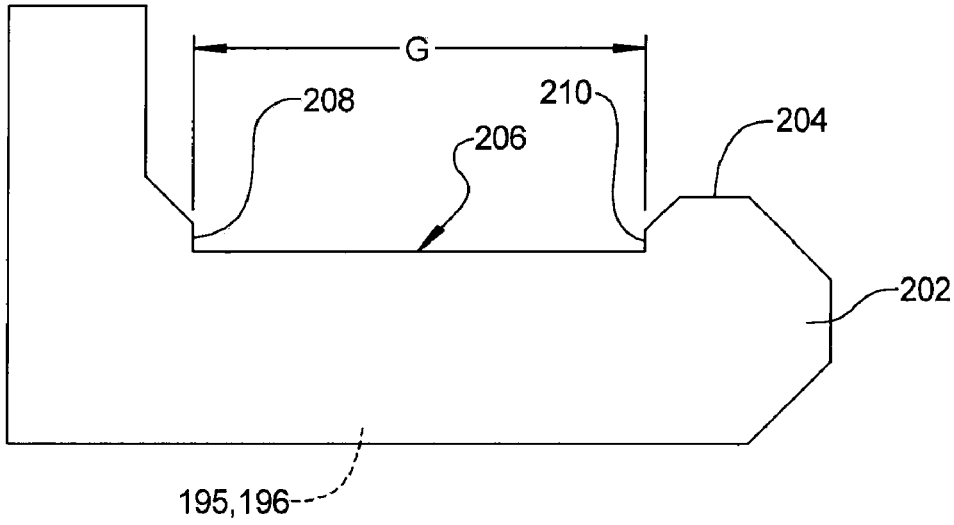
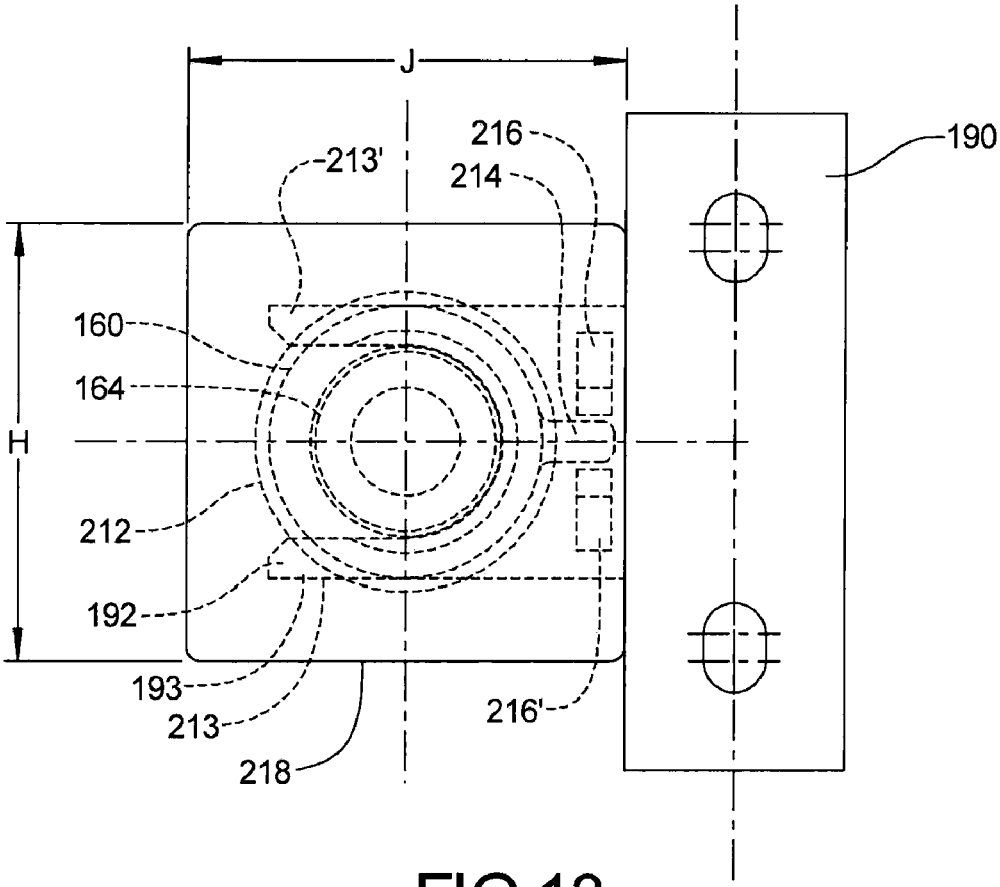
FIG 13

FIG 14
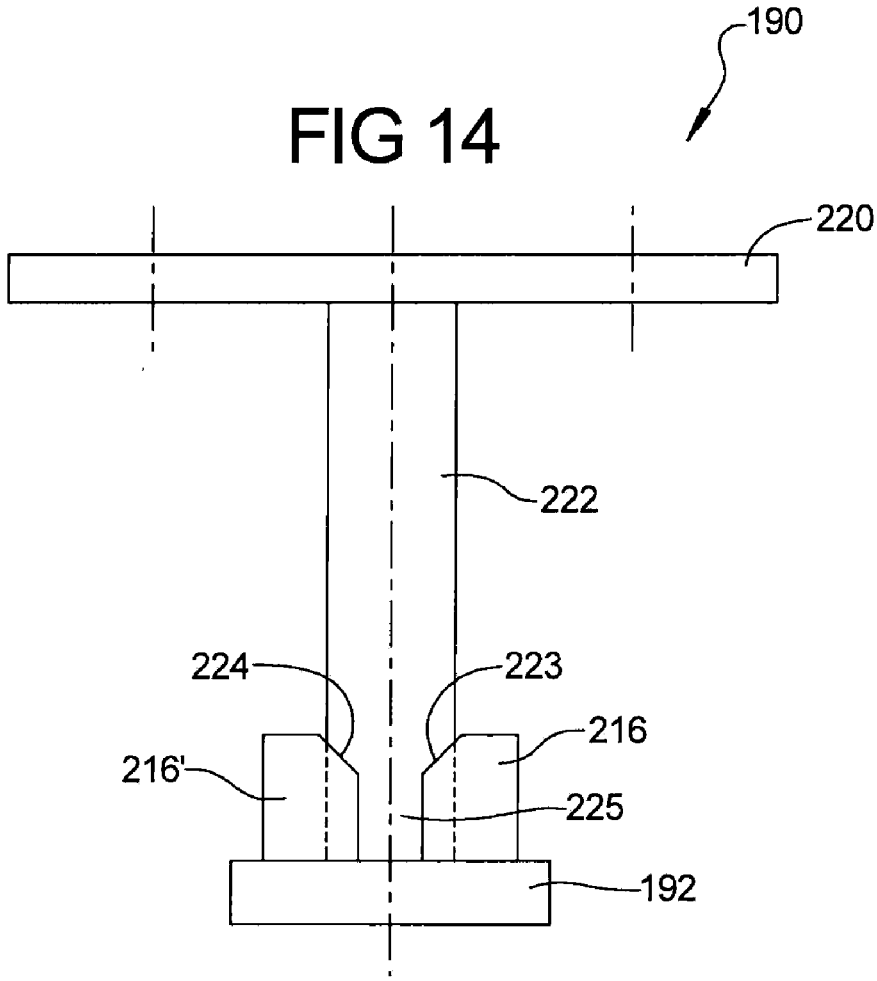
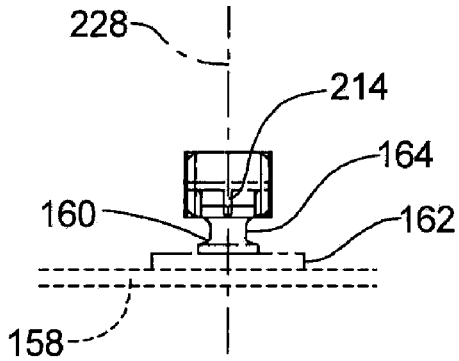
FIG 16

METHOD AND APPARATUS FOR MANIPULATING INVESTMENT CASTING MOLD HANDLERS

FIELD

The present disclosure relates to an investment casting process and a system to control investment casting mold handlers throughout a molding process.

BACKGROUND

This section provides background information related to the present disclosure which is not necessarily prior art.

Investment casting mold systems commonly include a continuous conveyor system. At one point of the conveyor uncoated wax molds are initially attached and/or completed molds are removed. As the conveyor progresses each mold has multiple operations or steps performed thereto, commonly including rinsing, dipping, sanding, and drying steps. Due to the space envelope required for a conveyor system, an individual mold is not commonly accessible after leaving the entry point until it completes at least one circuit of the conveyor. Also, when different types of molds are on the conveyor at the same time, common systems do not provide for different drying rates, therefore a complex mold may have to be retained on the conveyor for multiple passes to provide suitable drying time. An additional issue with common conveyor systems is that multiple vertical and horizontal motions may by incorporated, and damage to mold features such as sprues can result. The inability to individually remove a damaged mold at any point in the conveyor path can lead to wasted material application and lost time.

SUMMARY

This section provides a general summary of the disclosure, and is not a comprehensive disclosure of its full scope or all of its features.

According to several embodiments, an investment casting system includes an investment casting system including a mold transfer device operating to move a mold between at least two system sections, including a material application section having at least a first coating material to coat the mold; and a storage section receiving the mold following any one of a plurality of material coating phases in the material application section. The mold is stored in any one of a plurality of storage positions in the storage station and is selectively retrievable therefrom. The mold is accessible for removal from the system at any time and during any phase of operation on the mold.

According to further embodiments, an investment casting system includes an investment casting system includes a computer controlled mold transfer device operating to move a mold. The mold transfer device is movable between at least three stations including: a mold receiving station; a mold transfer station having a mold suspended from a first horizontally extending arm of the mold transfer device engaging an intermediate transfer device to transfer the mold to the intermediate transfer device; and a storage station having a storage rack receiving the mold following a material coating phase. A robot is in communication with the intermediate transfer device. The robot is programmed to position the mold in any of multiple material coating stations during the material coating phase. A computer control system operates to automatically identify a location of the mold and to control movement of the mold transfer device. The mold is accessible for removal from the system at any time during creation of the mold by selective operation of the computer control system.

According to still further embodiments, an investment casting system for creating a plurality of investment casting molds includes a computer controlled mold transfer device including a first horizontally extending arm operating to releasably couple any one of the molds for transfer. An intermediate transfer device includes a second horizontally extending arm, the second horizontally extending arm operating to horizontally transfer any one of the molds to and from a material application section. A storage station has a plurality of space envelopes individually adapted to temporarily store at least one of the molds following any one of a plurality of material coating phases in the material application section. Any one of the molds temporarily stored in the storage station is selectively retrievable. A computer control system operates to automatically identify a location of any one of the molds in the system and to control movement of the mold transfer device and the intermediate transfer device. Any one of the molds is accessible for removal from the system at any stage of completion by direction of the computer control system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 12 is a front elevational view of a connection end of the transfer arm assembly of FIG. 10;

FIG. 13 is a top plan view of a mold connection member connected for lifting a mold hanger;

FIG. 14 is a front elevational view of the mold hanger of FIG. 13;

FIG. 16 is a front elevational view of a connecting member of the present disclosure.

Corresponding reference numerals indicate corresponding parts throughout the several views of the drawings.

DETAILED DESCRIPTION

Figure 1:
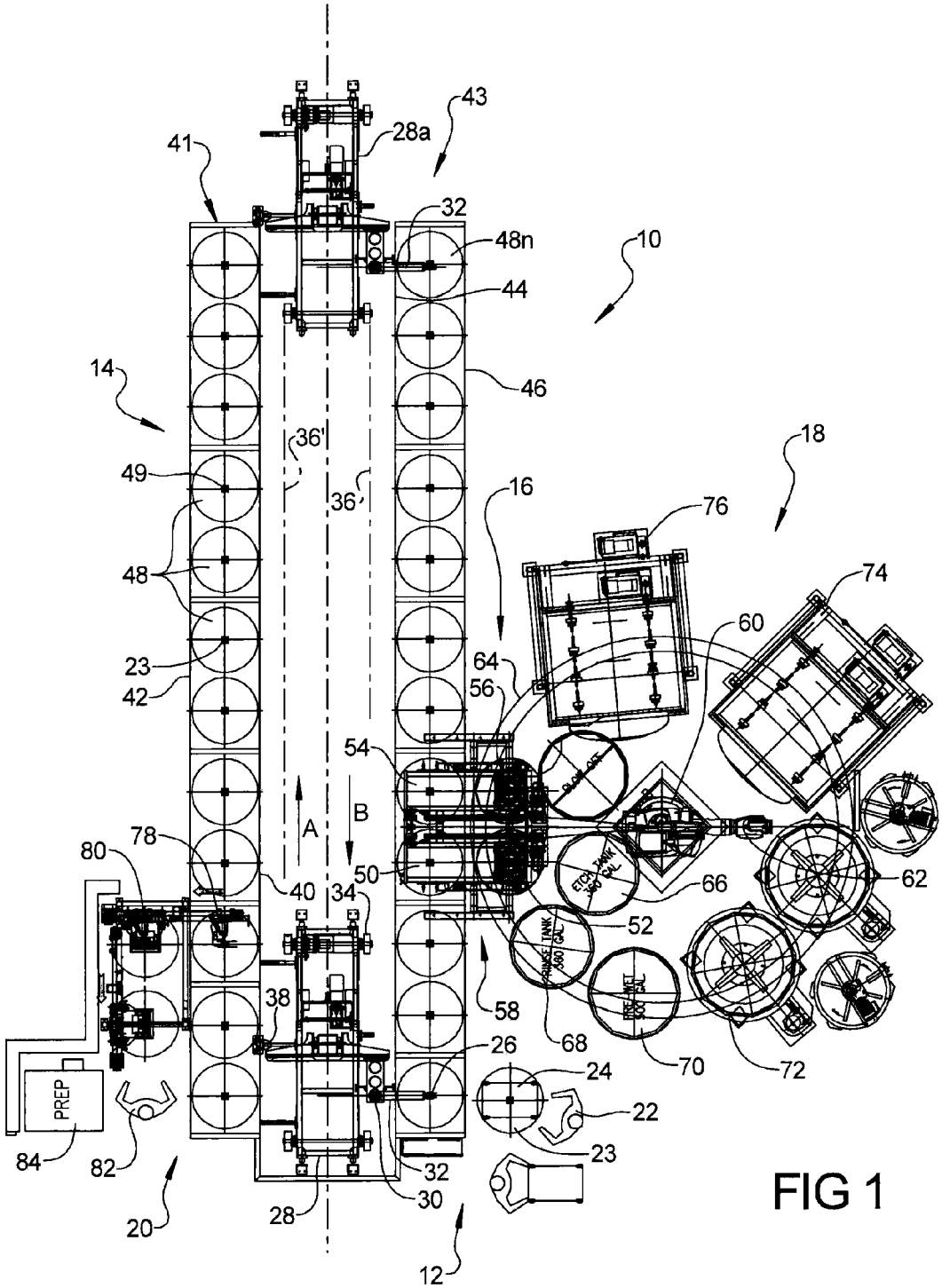
FIG. 1 is a top plan view of an investment casting mold handler system of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, an investment casting mold handling system 10 can include an intake section 12, a storage/drying section 14, a transfer section 16, a material application section 18 and a discharge section 20. At intake section 12 an operator 22 can manually transfer a wax mold 23 from an entry station 24 to a receiving station 26. Wax mold 23 is suspended during the intake and all transfer and storage portions of the investment casting mold handling system 10. Upon reaching receiving station 26, all further movement of wax mold 23 is automatically controlled and no further manual contact with wax mold 23 is required until the wax mold has completed all of its coating steps and drying steps and is removed from the system at discharge section 20.

Storage/drying section 14 includes an automated mold transfer device 28 which includes a horizontal transfer arm 30 having a suspension latch member 32 connected thereto. Automated mold transfer device 28 is movable by a set of wheels 34 in either a first transfer direction "A" or an opposite second transfer direction "B". A position sensor 38 can be provided with automated mold transfer device 28 to provide position feedback to accurately control a travel position of automated mold transfer device 28. Automated mold transfer device 28 is positioned proximate to an interior structure 40 of a first storage/drying portion 41. An exterior structure 42 provides an outer boundary structure of first storage/drying portion 41. On an opposite side of automated mold transfer device 28 a second storage/drying portion 43 is provided having a second interior structure 44 and a second exterior structure 46. First and second storage/drying portions 41, 43 provide a plurality of mold storage sites 48 which can each receive either one of the wax molds 23 or a coated mold 49. Coated molds 49 are created when wax molds 23 are passed through material application section 18. Each of the wax molds 23 or coated molds 49 are supported in a suspended orientation in each of the mold storage sites 48.

An off-load transition station 50 is provided in either one of first or second storage/drying portions 41, 43 which is positioned proximate to material application section 18. In the exemplary embodiment of FIG. 1, off-load transition station 50 is created in second storage/drying portion 43. The off-load transition station 50 receives one of the wax molds 23 or coated molds 49 from automated mold transfer device 28 for subsequent transfer to the material application section 18. A mold pick-up station 52 is positioned horizontally proximate to off-load transition station 50 to allow the wax mold 23 or coated mold 49 to be moved out of second storage/drying portion 43. A mold drop-off station 54 is also created in second storage/drying portion 43 adjacent to off-load transition station 50. An on-load transition station 56 is horizontally positioned proximate to mold drop-off station 54 so that wax mold 23 or coated mold 49 received in on-load transition station 56 can be translated horizontally to mold drop-off station 54. Each of the off-load transition station 50, the mold pick-up station 52, the mold drop-off station 54, and the on-load transition station 56 form a portion of an intermediate transfer system 58. Intermediate transfer system 58 defines the transfer section 16 allowing mold transfer from storage/drying section 14 to material application section 18 or an opposite movement of the mold from material application section 18 to storage/drying section 14. It is noted that the orientation of either the wax mold 23 or the coated mold 49 in any of the stations of intermediate transfer system 58 are maintained in a suspended state defined as the center of mass or weight of either the wax mold 23 or the coated mold 49 is positioned below a support connection, so that the molds are predisposition for the steps of material application section 18.

Material application section 18 includes a robot 60 having a robot arm 62 radially extendable through an arc of rotation 64. Arc of rotation 64 permits the robot 60 to move either the wax mold 23 or the coated mold 49 between each of a pre-wetting tank 66, an etch tank 68, a rinse tank 70, and a ceramic slurry tank 72 where the suspended orientation of the molds permits them to be dipped downwardly into and vertically upwardly withdrawn from any of the tanks minimizing angular motion of the molds.

Material application section 18 further includes first and second grain size sand coating drums 74, 76. After the molds are dipped into any or all of the tanks 66, 68, 70, or 72, each mold can be inserted using robot 60 and robot arm 62 into one of the first or second grain size sand coating drums 74, 76 where a coating of sand is applied over the mold. Different grain size sands are provided for each of the first and second grain size coating drums 74, 76 for different types or sizes of the molds and different coating thicknesses.

A mold is initially introduced into material application section 18 by transfer from off-load transition station 50 to mold pick-up station 52 where robot arm 62 engages the mold and removes it from mold pick-up station 52. When a predefined sequence of operations are performed on the mold in material application section 18, the mold is returned to storage/drying section 14 by offloading the mold to the on-load transition station 56 where it is subsequently horizontally moved to the mold drop-off station 54. When the mold is received in mold drop-off station 54 it is accessible by automated mold transfer device 28 to be retrieved or deposited at one of the plurality of mold storage sites 48 or delivered to the discharge section 20 if mold formation is complete. Each mold as either the wax mold 23 or the coated mold 49 can be temporarily stored in one of the mold storage sites 48 for an indefinite period of time to allow for drying of the mold or for subsequent pick up by automated mold transfer device 28 for a first, second or later transfer to the material application section 18.

When an individual coated mold 49 is complete, it is transferred by automated mold transfer device 28 to a discharge receiving station 78. From discharge receiving station 78 the finished mold is manually translated to an off-load station 80 by an operator/programmer 82 for subsequent performance of a casting operation. A control unit or computer control system 84 is provided with mold handling system 10 allowing operator/programmer 82 to enter individual commands into computer control system 84 defining how each individual mold is handled by mold handling system 10. Multiple different molds having different mold geometries can therefore be accommodated by mold handling system 10 through the use of individual programs entered or stored in computer control system 84. It is also possible through the use of computer control system 84 for the operator/programmer 82 to direct automated mold transfer device 28 to remove any individual mold from mold handling system 10 at any time or at any point of operation for any reason, for example if it is discovered that the individual mold has been damaged, which can occur by disconnection of a mold sprue. Additional cycles through material application section 18 can also be added by operator/programmer 82 if warranted.

It is therefore possible for any individual mold in mold handing system 10 to be accessed at any operating stage or location of the system. Under normal operating conditions computer control system 84 will notify operator/programmer 82 when any individual one of the molds has completed its predetermined number of cycles through material application section 18 and storage/drying section 14. Under normal operating conditions of mold handling system 10 individual molds are completely autonomously handled by automated mold transfer device 28 via commands or one or more programs entered into computer control system 84 or modified by the operator/programmer.

Figure 2:
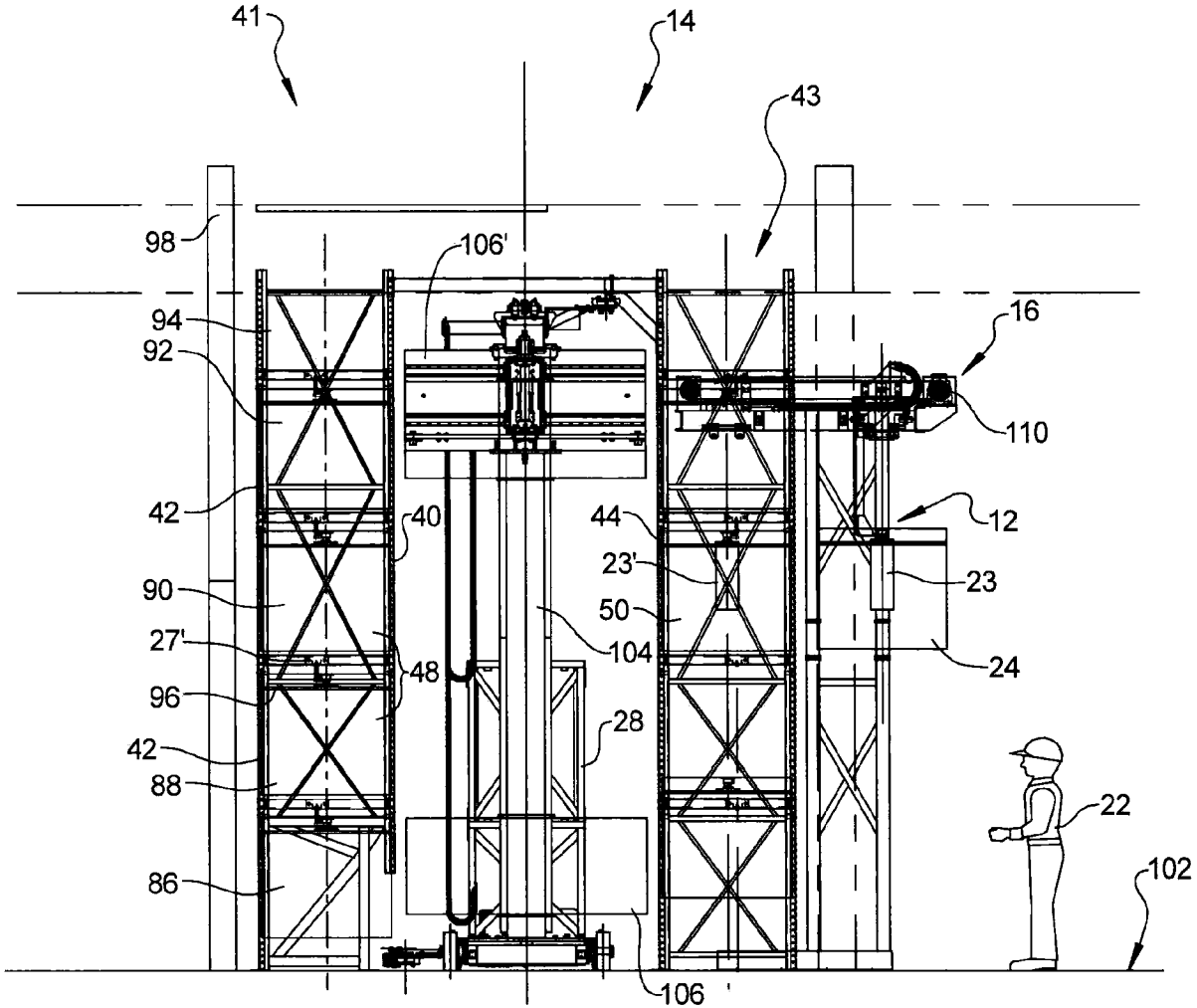
FIG. 2 is a front elevational view of a mold storage and handling portion of the system of FIG. 1.

Referring to FIG. 2, each of the first and second storage/drying portions 41, 43 can include a plurality of storage levels for example first, second, third, fourth, and fifth mold storage levels 86, 88, 90, 92, 94. Each mold in individual ones of the mold storage levels is separated by a level dividing member 96 from which the mold is suspended. According to several embodiments different drying times can be provided for molds in different areas of storage/drying section 14. For example, by providing a first humidity controlled ventilation section 98 supplying dried ventilation air to first storage/drying portion 41 and a second humidity controlled ventilation section 100 to supply humidity controlled ventilation to second storage/drying portion 43, by varying humidity levels in each of the first and second humidity controlled ventilation sections 98, 100 different drying times or different drying rates for the molds can be provided. As shown in FIG. 2, each of the mold storage levels 86, 88, 90, 92, 94 are vertically disposed with respect to a ground surface 102. In alternate embodiments the mold storage levels can be increased or decreased from this quantity or can be positioned horizontally with respect to ground surface 102. In order to reach all of the storage levels of storage/drying section 14, automated mold transfer device 28 includes a vertical lift segment 104 which is capable of vertically translating a mold carrying member 106 which lifts and then horizontally transfers a mold carried by automated mold transfer device 28 into any of the mold storage sites 48 or reverses this process to retrieve/withdraw a mold.

Transfer section 16 includes a first horizontal transfer device 108 operating to horizontally translate the wax mold 23 from entry station 24 to receiving station 26. A second horizontal transfer device 110 operates to horizontally translate wax mold 23' from off-load transition station 50 to mold pick-up station 52.

Figure 3:
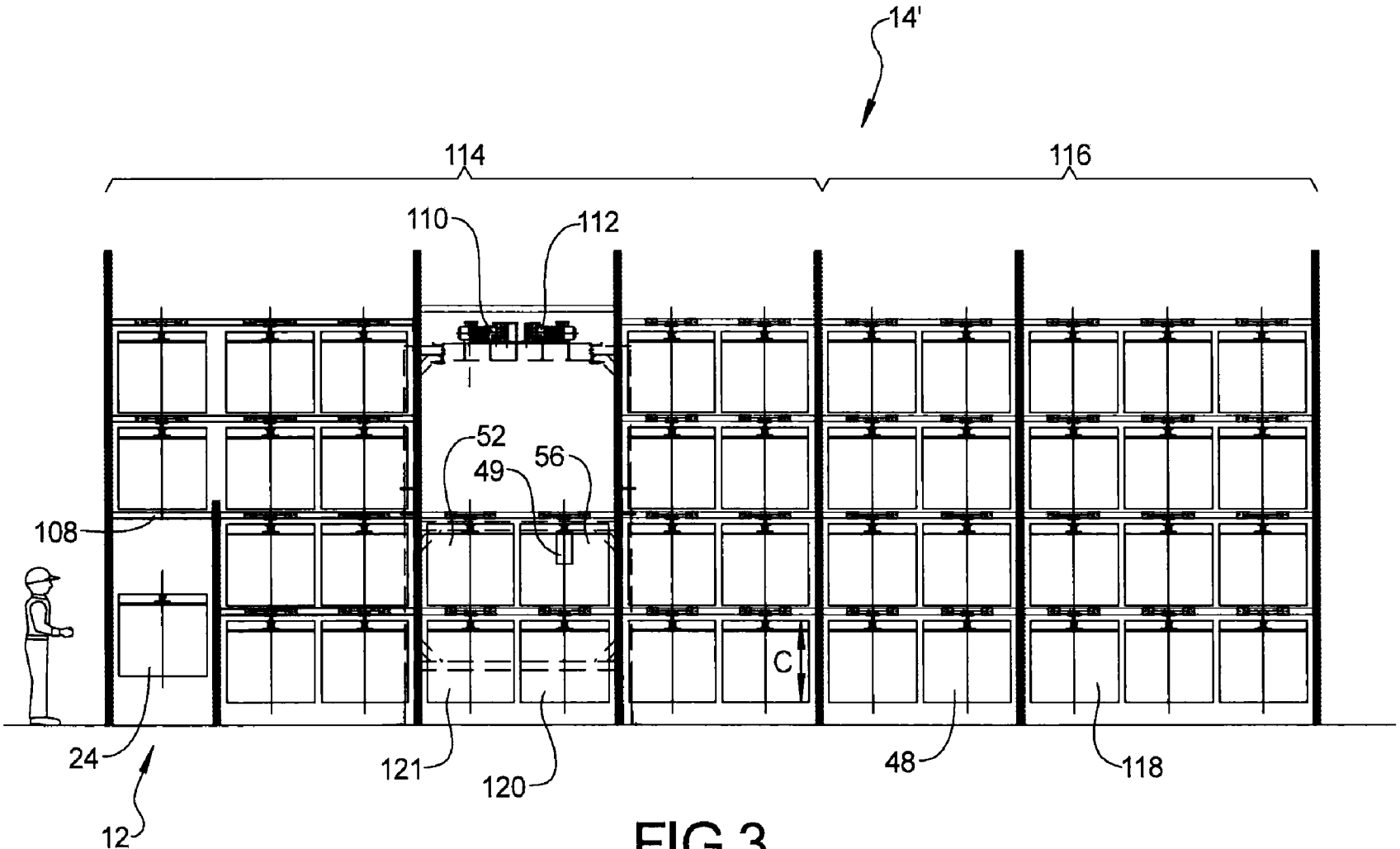
FIG. 3 is a side elevational view of the mold storage and handling portion of the system of FIG. 1.

Referring to FIG. 3, a third horizontal transfer device 112 similar to second horizontal transfer device 110 horizontally translates one of the coated molds 49 from on-load transition station 56 inwardly to mold drop-off station 54 (not visible in this view). Storage/drying section 14' can be further modified to provide a first storage segment 114 separated from a second storage segment 116. The use of independent first and second storage segments, 114, 116 can provide multiple operating features. These features include but are not limited to the ability to segregate different types of molds between the different first and second storage segments 114, 116. Also, molds which require different drying times can be further segregated into one of the first or second storage segments 114, 116. Further uses for segregating the molds into different storage segments can also include the ability to segregate completed molds from molds requiring further material application in material application section 18, to limit the horizontal travel distance for molds between material application cycles.

According to several embodiments, each of the mold storage sites 48 can be provided with a common storage level height "C", however, individual mold storage sites such as a mold storage site 118 can have dimensionally different limitations compared to a mold storage site 120 at the discretion of the designer. This further provides for the storage of molds of different sizes or geometries in storage/drying section 14'. It is noted that each of the individual mold storage sites such as mold storage sites 118, 120 has a unique identifier 121 stored in computer control system 84 such that mold handling system 10 is able to individually recognize a location and the envelope size of each one of the storage sites.

Figure 4:
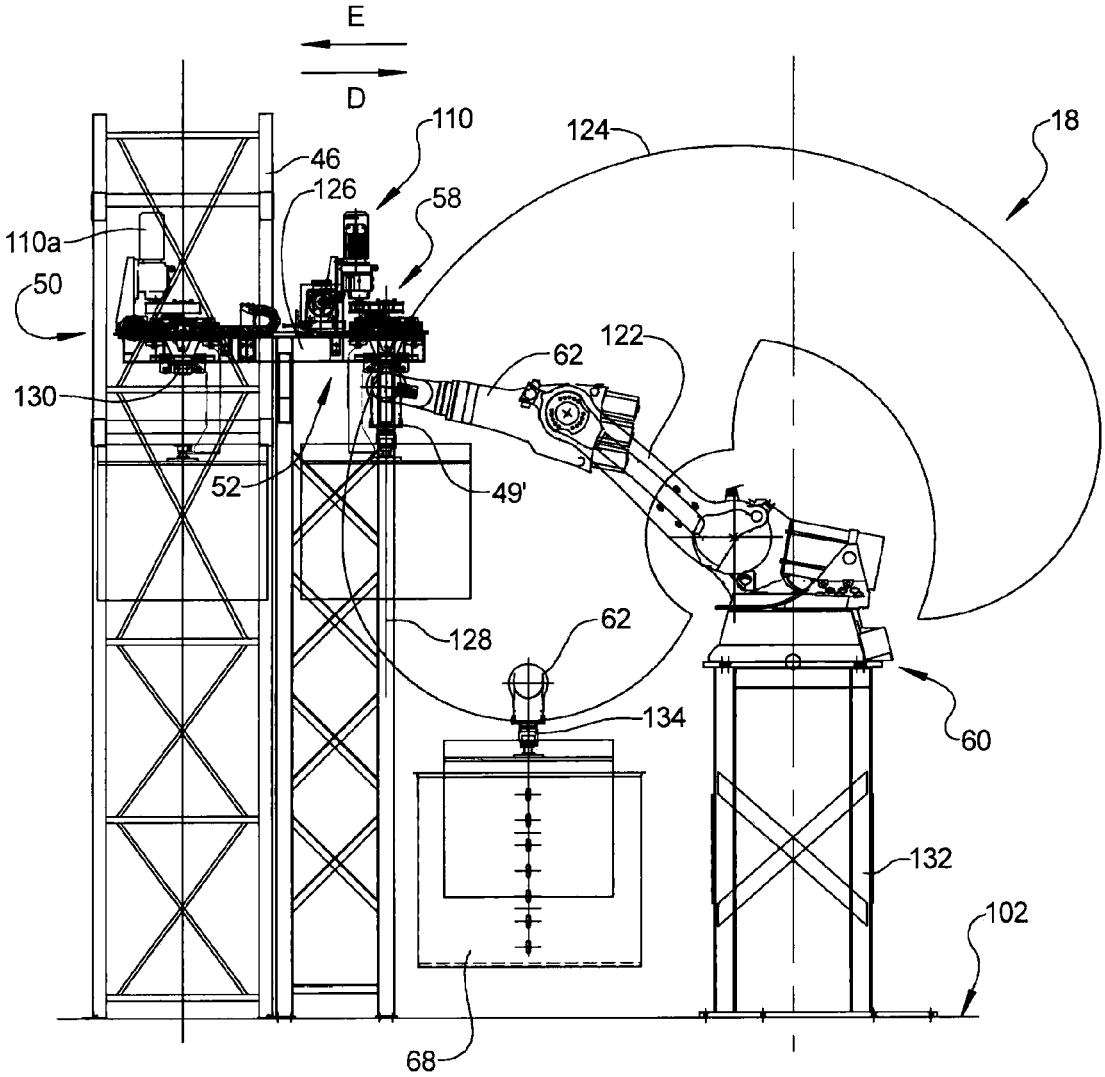
FIG. 4 is a front elevational view of a robotic mold handling portion of the system of claim 1.

Referring to FIG. 4, robot 60 can further include an extension member 122 which permits robot arm 62 to extend outwardly to the robot arm extension arc 124 so that molds such as coated mold 49' can be accessed from intermediate transfer system 58. Second horizontal transfer device 110 is supported using a horizontal support track 126 structurally supported using a transfer device support structure 128 positioned outward of second exterior structure 46. An elevation of horizontal support track 126 above ground surface 102 is predetermined to provide access by robot arm 62 to any of the tanks including etch tank 68 shown. Second horizontal transfer device 110 as well as third horizontal transfer device 112 (not shown in this view) each include a transfer device suspension coupling device 130 capable of grasping and retaining either a wax mold 23 or a coated mold 49 as shown for translation for example from the off-load transition station 50 to the mold pick-up station 52 in an outward transfer path "D", or, oppositely from the mold pick-up station 52 to the off-load transition station 50 in a return transfer path "E". Second horizontal transfer device 110 is therefore capable of translation horizontally from the position shown as second horizontal transfer device 110 and the position shown as second horizontal transfer device 110*a*. As previously noted, robot 60 is supported above ground surface 102 using a robot support structure 132 whose height is predetermined to permit motion of robot arm 62 about the robot arm extension arc 124. A robot suspension coupling 134 similar in function to transfer device suspension coupling device 130 is coupled at a free end of robot arm 62 to permit any of the molds supported by robot 60 to be vertically suspended to provide for vertical operation for example dipping into etch tank 68.

Figure 5:
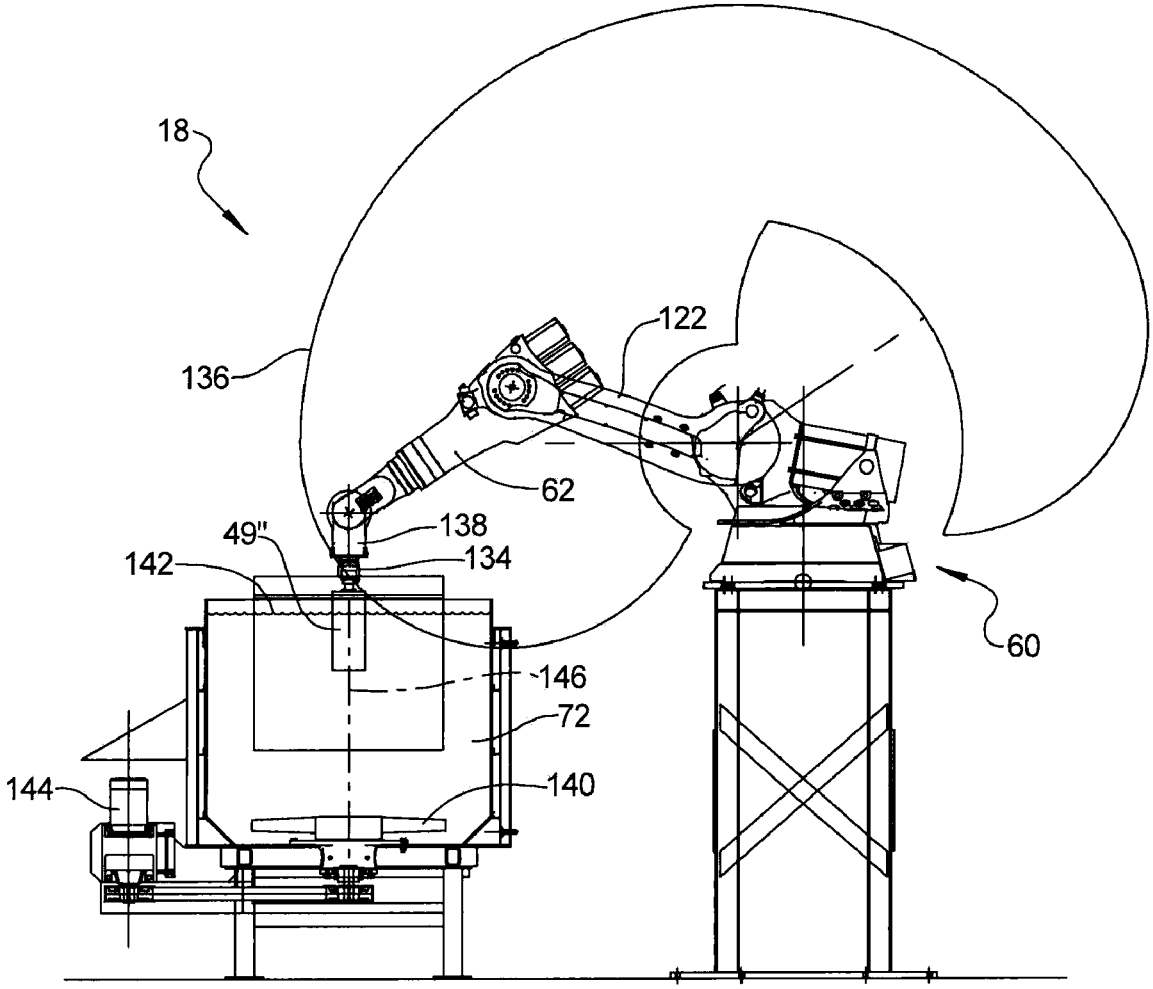
FIG. 5 is a front elevational view of the robotic mold handling portion of FIG. 4 showing a dipping step.

Referring to FIG. 5, for suspending coated mold 49" into ceramic slurry tank 72, an alignment arm 138 is connected between robot arm 62 and robot suspension coupling 134 allowing rotation of robot arm 62 and robot suspension coupling 134 about a modified extension arc 136 preprogramable into robot 60. Also preprogrammed for operation of robot 60 is a length of time coated mold 49" remains suspended in ceramic slurry tank 72. A stirring member 140 can be provided in ceramic slurry tank 72 to stir a coating material 142 suspended in a slurry mixture using a stir motor 144. This ensures that the suspended material in ceramic slurry tank 72 is well mixed for even coating about coated mold 49". The rotational capability of extension member 122, robot arm 62, and alignment arm 138 permits coated mold 49 (or a previously uncoated wax mold 23 not shown) to be continuously retained by robot suspension coupling 134 on a vertical axis 146. This minimizes the amount of strain on wax mold 23 or coated mold 49 to further reduce the potential for damage to any of the component members of the mold.

Figure 6:
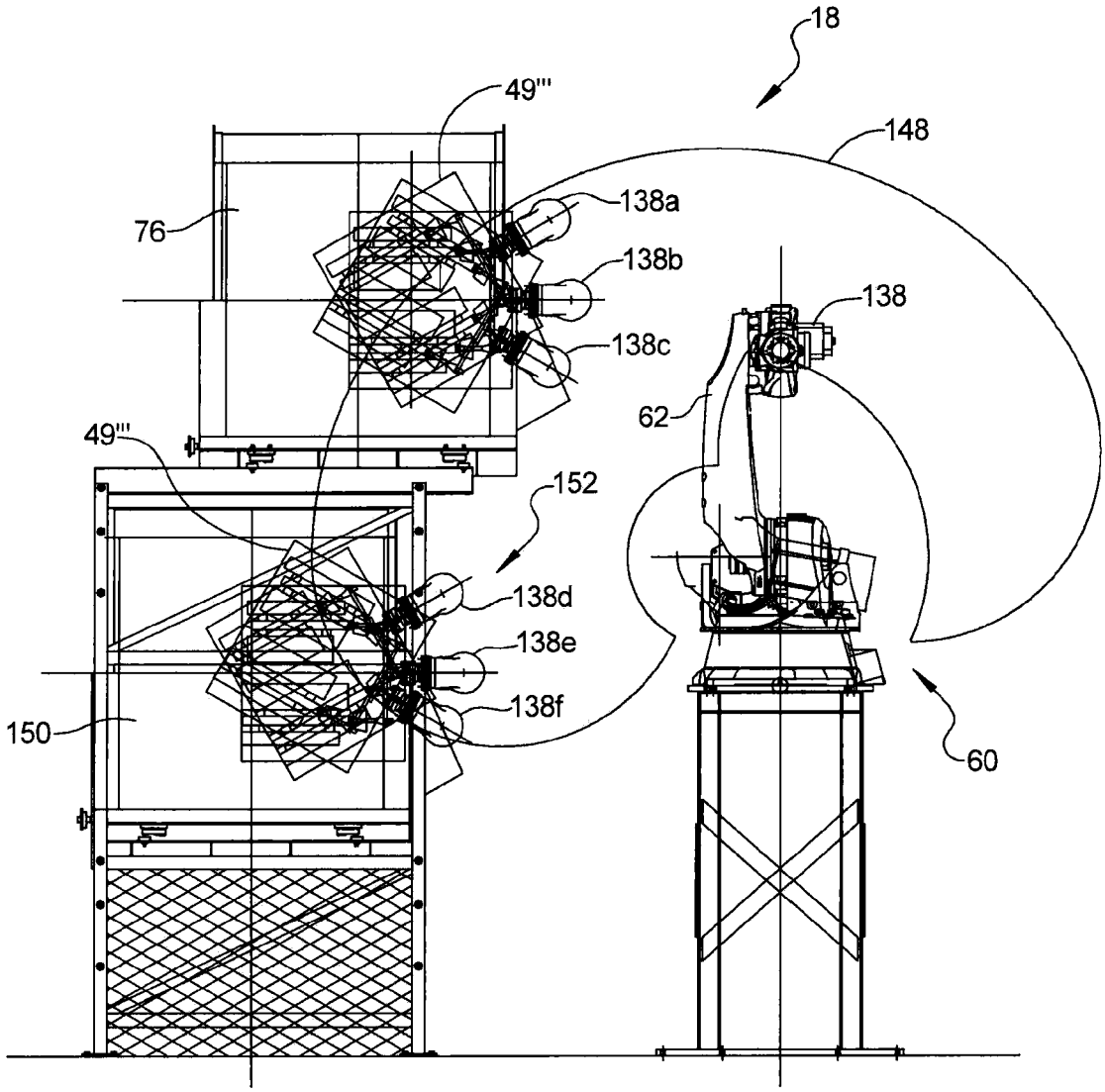
FIG. 6 is a front elevational view of the robotic mold handling portion of FIG. 4 showing sanding and drying steps.

Referring to FIG. 6, robot arm 62 is further capable of translation about a modified extension arc 148 to position coated mold 49''' into one of the first or second grain size sand coating drums 74, 76 (only second grain size sand coating drum 76 is shown) and further to change an orientation of coated mold 49''' for example between the positions indicated for alignment arm 138 between orientations 138*a*, 138*b*, and 138*c* in a substantially infinite variety of angular orientations needed to ensure full and even sand coating of the coated mold 49'''. Modified extension arc 148 further permits moving coated mold 49''' into a plenum 150 of a dryer unit 152 and further to orient coated mold 49''' in multiple angular orientations within plenum 150, shown for example as various orientations of alignment arm 138*d*, 138*e*, 138*f*. This permits substantially infinite angular orientation of coated mold 49''' to achieve optimum drying performance within dryer unit 152.

Referring again to FIGS. 1-6, operation of investment casting mold handling system 10 can occur as follows. Initially a mold 23 is manually loaded into mold handling system 10 by an operator 22 at entry station 24 where the wax mold 23 is horizontally translated into receiving station 26 for subsequent pickup by automated mold transfer device 28. Automated mold transfer device 28 subsequently retrieves the wax mold 23 from receiving station 26 and can transfer wax mold 23 to any of the plurality of mold storage sites 48 of storage/drying section 14, or can also immediately transfer the wax mold 23 directly into material application section 18. The computer control system 84 is preprogrammed with the plurality of steps and motions of wax mold 23 as it initially enters mold handling system 10 and as it is coated and handled as a coated mold 49. An exemplary cycle through material application section 18 includes transfer from off-load transition station 50 to mold pick-up station 52 where robot arm 62 couples to the wax mold 23 and wax mold 23 is released from mold pick-up station 52. The wax mold 23 can then be dipped into pre-wetting tank 66, then into etch tank 68, followed by dipping into rinse tank 70. From rinse tank 70, wax mold 23 is dipped into ceramic slurry tank 72 and subsequently moved into one of the first or second grain size coating drums 74 or 76 where a sand coating is applied to the exterior of the ceramic material previously coated onto the mold. The sand coated mold is then transferred into a dryer such as dryer unit 152 allowing the ceramic slurry coating and sand coating to adhere to and harden on the mold.

Figure 7:
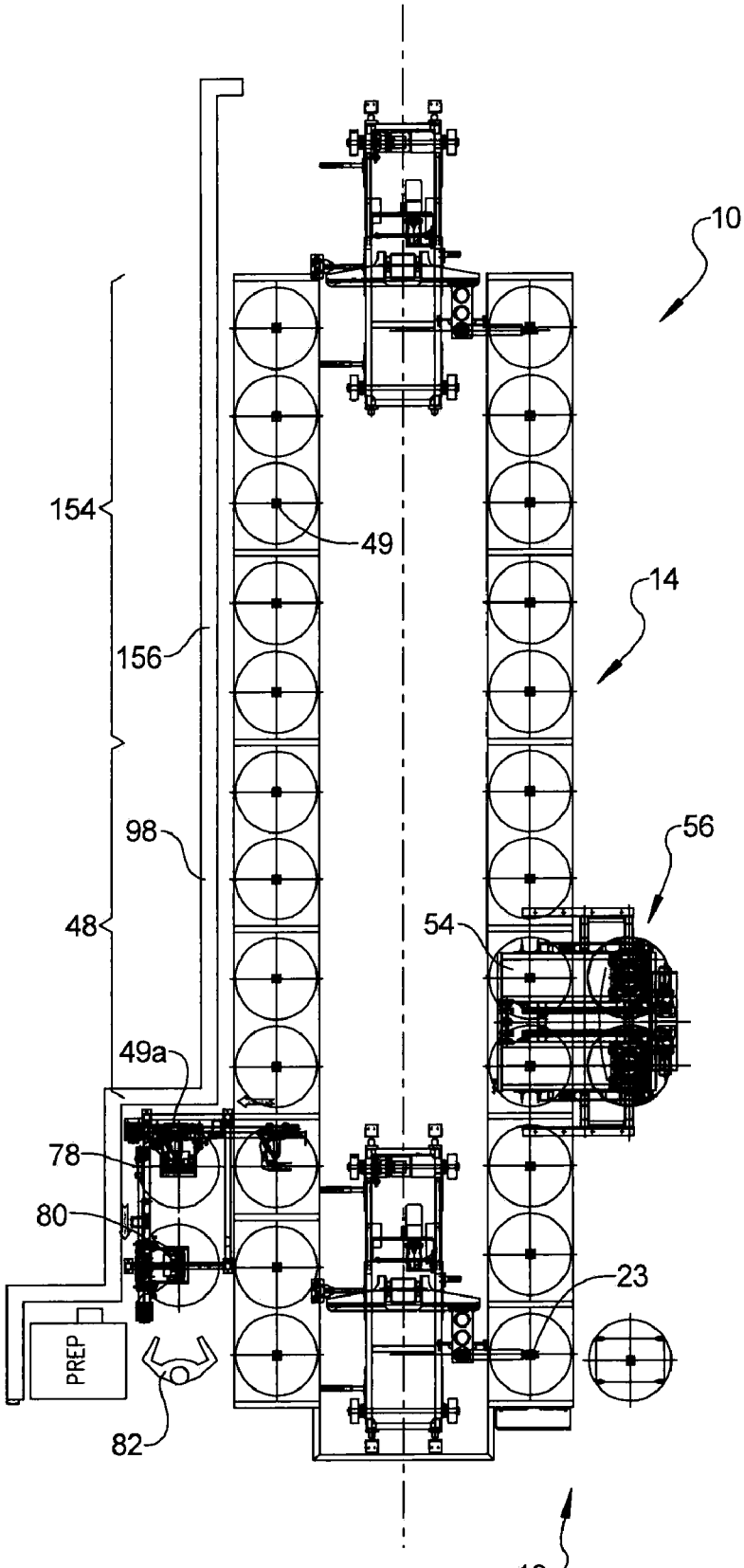
FIG. 7 is a top plan view of the storage area and automatic storage and retrieval device of FIG. 1.

Referring to FIG. 7 and again to FIG. 1, the coated mold is moved by robot 60 to on-load transition station 56 for horizontal translation to the mold drop-off station 54. Automated mold transfer device 28 retrieves the coated mold at the mold drop-off station 54 and moves it to one of the plurality of mold storage sites 48 for a subsequent drying period of predetermined length. This cycle can be repeated by further retrieval by automated mold transfer device 28 and reentry into the material application section 18 for as many coating and drying steps as required for the particular mold.

During drying in storage/drying section 14, coated molds 49 can be positioned in two or more sections of storage/drying section 14, shown for example as mold storage sites 48 and mold storage sites 154. Where drying air provided via first humidity controlled ventilation section 98 can be delivered to mold storage sites 48, a higher or lower volumetric flow rate of the humidity controlled air can be delivered to mold storage sites 154 via a volume delivery controlled portion 156 of first humidity controlled ventilation section 98. This permits drying rates to be further controlled by delivery of a higher or lower volume of drying air (for example at a higher or lower velocity of flow, or higher or lower total volumetric flow rate) to coated molds 49 which are temporarily stored in mold storage sites 154 compared to mold storage sites 48.

When the coated mold has received the predetermined number of layers of coating and has dried sufficiently to be off-loaded from mold handling system 10, automated mold transfer device 28 is commanded to retrieve the finished, coated mold (for example designated as mold 49*a*) from the appropriate mold storage site 48 or 154 for transfer to the discharge receiving station 78. The operator/programmer 82 at discharge receiving station 78 can manually transfer the coated mold 49 to off-load station 80 where the coated mold 49 can then be moved to either a temporary storage location or directly into a casting facility (not shown) where a casting material can be poured into the mold. The computer control system 84 as previously discussed controls each of the movement steps of the wax mold 23 or coated mold 49 throughout its flow path through mold handling system 10.

Referring to FIG. 8 and again to FIG. 1, multiple coated molds 49', 49" can be simultaneously handled at off-load transition station 50, mold pick-up station 52, mold drop-off station 54, and on-load transition station 56. A hanger plate 158 can be adapted to support one or more coated molds 49. Hanger plate 158 can be rotated with respect to a support axis 159 using a connection member 160. Connection member 160 is fixed to a plate 162 which in turn is fixed to hanger plate 158. Connection member 160 includes a reduced diameter portion 164 which is substantially circular in shape which acts as both a connection point and rotational surface. Connection member 160 is releasably coupled to a lift and horizontal transfer device 166. A compensator shaft 168 permits horizontal (side-to-side as viewed in FIG. 8) motion of horizontal transfer device 166 to permit coupling with connection member 160. First and second springs 169, 169' are oppositely deflectable to permit horizontal motion of horizontal transfer device 166.

Horizontal transfer device 166 can subsequently couple hanger plate 158 to a rack connector/hanger 170 provided in individual ones of the mold storage sites 48 of storage/drying section 14 to store the molds 49. It is therefore possible to temporarily store one or more than one mold 49 in each of the storage sites 48 when supported from hanger plate 158. Each of the molds 49 supported by hanger plate 158 fit within a space envelope 171 which is predetermined to fit within any of the storage sites 48. First and second structural plates 172, 174 slidably support compensator shaft 168.

Figure 8:
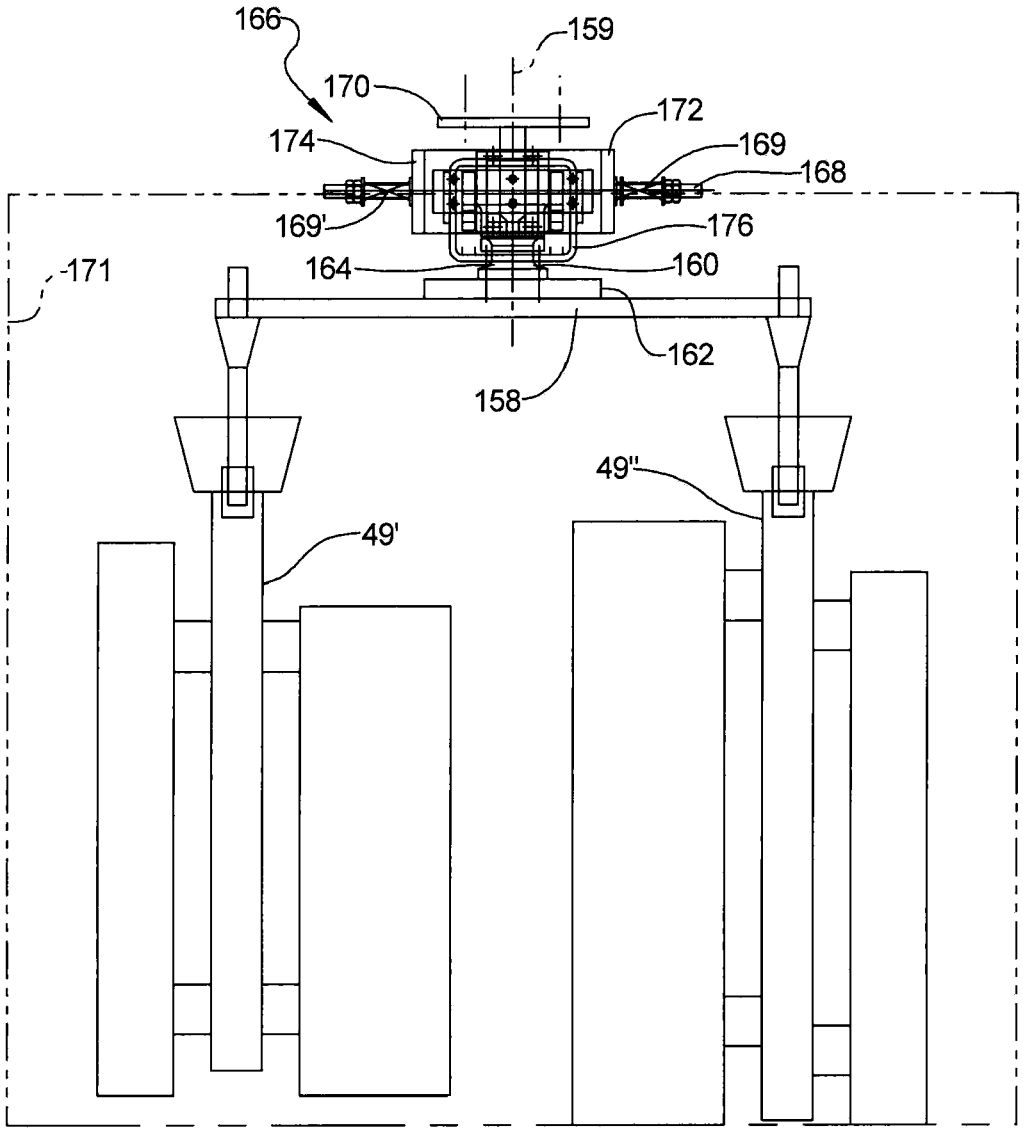
FIG. 8 is a front elevational view of a transfer operation for multiple mold handlers using the automatic storage and retrieval device of FIG. 1.

Referring to FIG. 9 and again to FIG. 8, horizontal transfer device 166 provides for rotational motion of support/transfer arm 176 by keyed connection to a motor rotated shaft 177. A key 178 splined to motor rotated shaft 177 is engaged with a coupling tube 180 fixed to support/transfer arm 176. Compensator shaft 168 is fixed to support/transfer arm 176. First and second structural plates 172, 174 are both fixed to a common structural plate 182, such that first and second structural plates 172, 174 and common structural plate 182 form a structural unit 184. Structural unit 184 can displace horizontally in each of opposed first and second deflection directions "F" and "G" with respect to support/transfer arm 176 by compression or expansion of first and second springs 169, 169'. Opposed first and second bracket arms 186, 188 extending from structural unit 184 can insert or retrieve a suspended mold temporarily supported on a hanger 190 in one of the space envelopes 171. Hanger 190 includes a U-shaped bracket 192 adapted to couple with the connection member 160 of hanger plate 158. The horizontal displacement provided by springs 169, 169' of structural unit 184 therefore permit automatic alignment of first and second bracket arms 186, 188 with a vertical axis 193 of the suspended mold.

Figure 10:
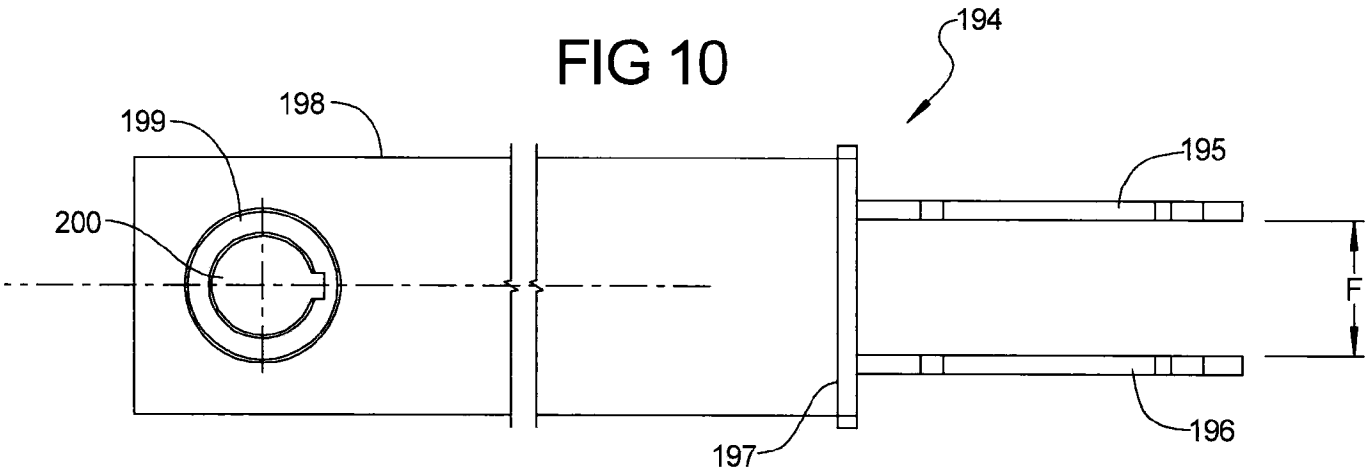
FIG. 10 is a top plan view of a portion of the transfer arm assembly of FIG. 9.
Figure 11:
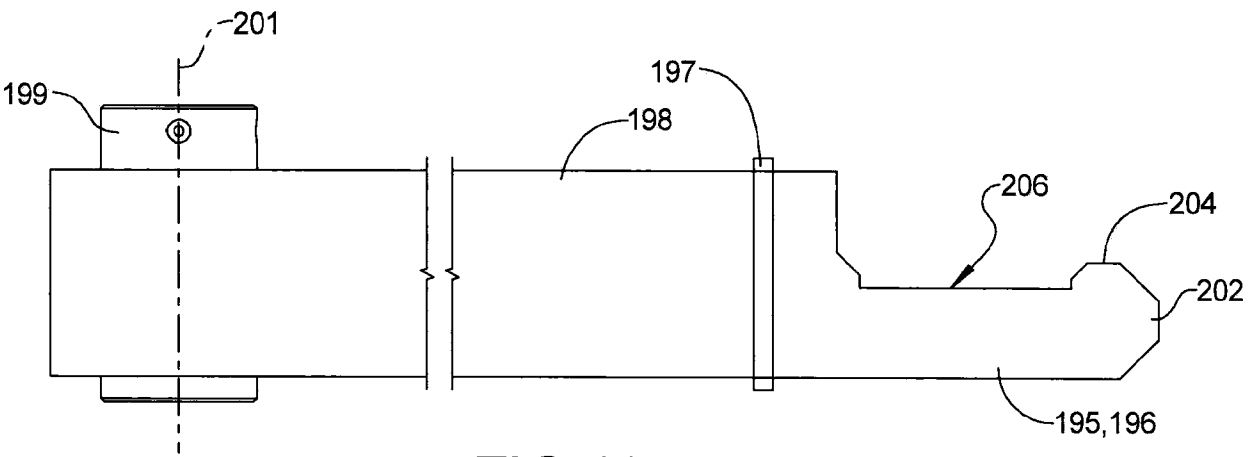
FIG. 11 is a front elevational view of the transfer arm assembly of FIG. 10.

Referring to FIGS. 10 and 11, and again to FIG. 1, a further embodiment of a lift and horizontal transfer device 194 can be included with the automated mold transfer device 28. Transfer device 194 includes first and second hook-shaped brackets 195, 196 fixed to a plate 197, which in turn is fixed to a support transfer arm 198. First and second hook-shaped brackets 195, 196 are separated by a bracket spacing "F" which will be described in further detail in reference to FIG. 13. Support transfer arm 198 includes a coupling tube 199 which is keyed to a power actuated shaft 200 which is rotatable with respect to a tube longitudinal axis 201. Each of the first and second hook-shaped brackets 195, 196 include a hooked end 202 having a raised member 204 elevated above a planar hanger support surface 206.

Referring to FIG. 12, the hanger support surface 206 of each of first and second hook-shaped brackets 195, 196 are bounded by a first wall 208 and opposed second wall 210 whose purpose will be described in better detail in reference to FIG. 13. First and second walls 208, 210 can be oriented substantially transverse to hanger support surface 206, or be angled away from hanger support surface 206 defining a tapered or conical shape. A wall-to-wall spacing "G" is created at the junction of first and second hanger contact surfaces defined by first and second walls 208, 210 and hanger support surface 206.

Figure 9:
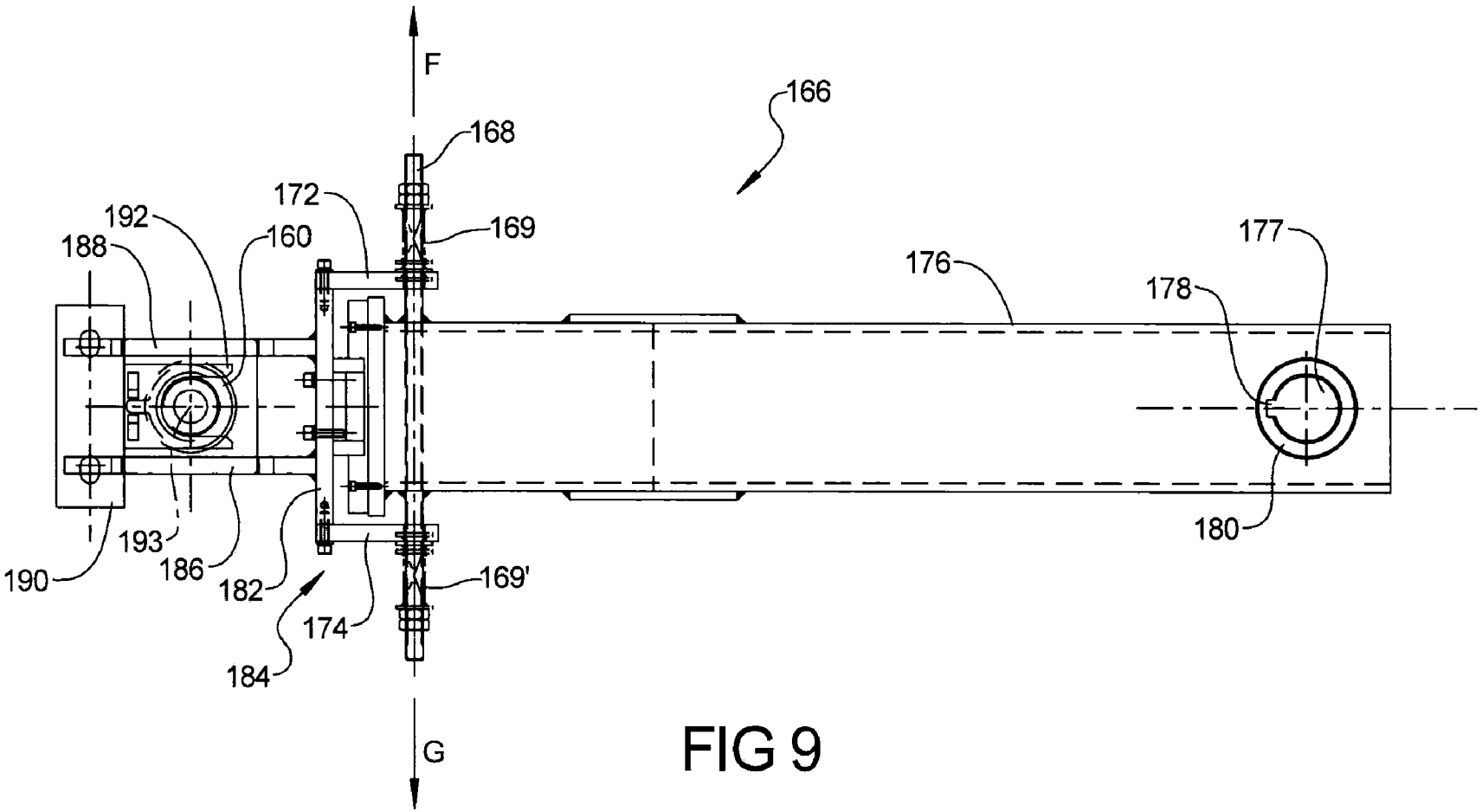
FIG. 9 is a top plan view of a transfer arm assembly and connection device of the automatic storage and retrieval device of FIG. 1.

Referring to FIG. 13 and again to FIGS. 1 and 9, the connection of connection member 160 to hanger 190 is shown in greater detail. A cylindrical portion 212 of connection member 160 is releasably captured by first and second bracket legs 213, 213' of U-shaped bracket 192. U-shaped bracket 192 is fixed to hanger 190. A male engagement member 214 of cylindrical portion 212 is non-rotatably engaged between first and second hanger ears 216, 216' which are fixed to U-shaped bracket 192 of hanger 190. Hanger 190 can be fastenably or otherwise fixedly connected to structure of storage/drying section 14. A hanger engagement plate 218 is connected to and supports connection member 160. Hanger engagement plate 218 has a width "H" and a length "J".

Referring to FIG. 14 and again to FIG. 13, hanger 190 can further include a hanger attachment plate 220 having a hanger post fixedly connected to and suspended from hanger attachment plate 220. U-shaped bracket 192 is fixedly connected to an opposite end of hanger post 222 with respect to hanger attachment plate 220. As previously noted, first and second hanger ears 216, 216' are each fixed to U-shaped bracket 192. First and second hanger ears 216, 216' individually include a first or second tapered surface 223 or 224 which permit alignment and insertion of male engagement member 214. An engagement member receiving slot 225 between first and second hanger ears 216, 216' provides clearance to slidably receive male engagement member 214 thereafter preventing rotation of connection member 160.

Figure 15:
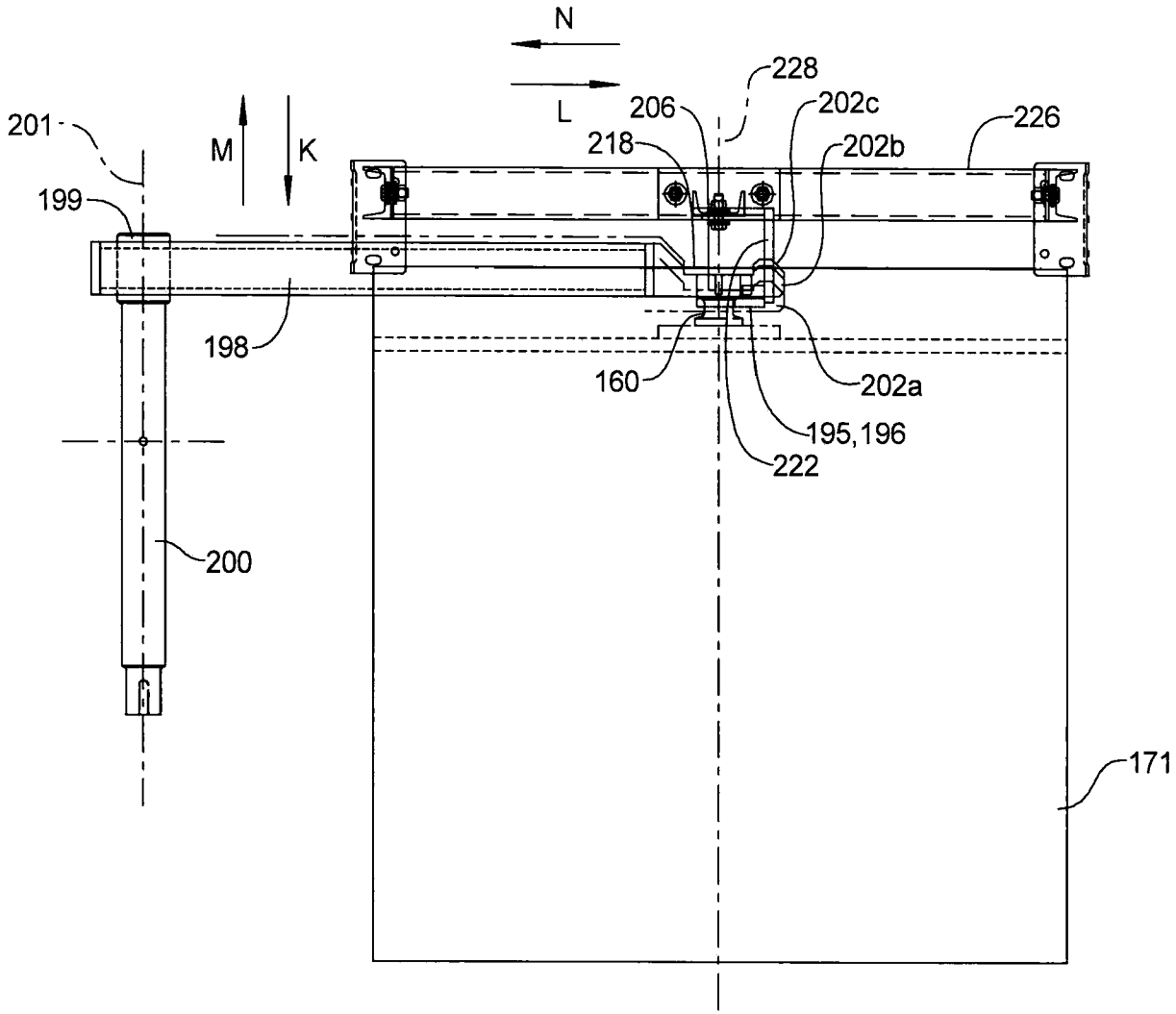
FIG. 15 is a front elevational view of a typical storage station accessible by the automatic storage and retrieval device of the present disclosure.

Referring to FIGS. 15 and 16 and again to FIGS. 10-14, to retrieve a mold temporarily stored in one of the space envelopes 171, support transfer arm 198 is first lowered in a downward direction "K" by lowering power actuated shaft 200. Support transfer arm 198 is next moved in a horizontal direction "L" until hooked end 202 of first and second hook-shaped brackets 195, 196 pass connection member 160. Hooked end 202 is at this time positioned as shown as hooked end 202*a*. Support transfer arm 198 is then raised in an upward direction "M" to move hooked end 202 upwardly until hanger support surface 206 contacts an underside of hanger engagement plate 218 which is indicated by the position of hooked end 202*b*. After contact with hanger engagement plate 218 is made, continued upward movement of support transfer arm 198 occurs to lift the mold until the position shown as hooked end 202*c* is reached at which time the mold can be horizontally withdrawn from space envelope 171 in a horizontal direction "N". To minimize the vertical displacement during lift of the mold and thereby minimize mold damage that could occur due to vertical acceleration, a vertical distance between the position of hooked end 202*b* and 202*c* is approximately 0.95 cm (0.375 in). Installation of a mold for temporary storage into one of the space envelopes 171 occurs by reversing the above withdrawal steps.

With further reference to FIGS. 10-14, the width "H" of hanger engagement plate 218 is greater than bracket spacing "F" between first and second hook-shaped brackets 195, 196 so that hanger engagement plate 218 will rest on top of first and second hook-shaped brackets 195, 196 to allow lifting of the mold. The length "J" of hanger engagement plate 218 is less than wall-to-wall spacing "G" to permit a sliding fit between first and second hanger contact surfaces defined by first and second walls 208, 210 so that a horizontal position of hanger engagement plate 218 with respect to tube longitudinal axis 201 of power actuated tube 200 and a central vertical axis 228 of connection member 160 will be maintained during mold transfer to provide a known system location for the mold.

Several advantages of the use of mold handling system 10 are provided by the elimination of a standard conveyor system which precludes access to the mold at any particular step and requires the mold to be moved in a complete cycle about the conveyor before it is accessible again. The combination of the use of robot 60, transfer section 16, and storage/drying section 14 allows any one of the molds at any point in mold handling system 10 to be accessed for either removal or for further coating steps. In addition, storage/drying section 14 can be designed to provide different sections or areas where controlled humidity ventilation can be varied so that a mold positioned in different areas of the storage/drying section 14 can be provided by different humidified drying air to further control the rate of drying to either lengthen or reduce the drying period for the mold. This permits larger or smaller molds which have different drying times based on the surface area to be coated or the complexity of the surface area to be coated to be handled differently within mold handling system 10 without removal of the mold prematurely or requiring an excessive stay time within the system before it can be removed.

The storage/drying section 14 as noted herein can include at least first and second humidity controlled ventilation sections 98, 100. The mold 49 is positioned in one of the plurality of space envelopes 171 of one of the first or second humidity controlled ventilation sections 98, 100 each providing a selectively different drying rate for the mold. A total drying time of the mold 49 is predetermined and stored in the computer control system 84 and is continuously compared using the computer control system 84 to the accumulated drying time of the mold 49 at the drying rate provided in the individual first or second humidity controlled ventilation sections 98, 100.

Further, the capability to horizontally transfer and translate any of the molds for any of the operations related to the storage/drying section 14 and or transfer section 16 minimize the period when the mold may not be positioned in its vertical suspended state and therefore minimize the stresses seen by the mold as it moves from one station to another. This mitigates against the potential for angularly twisting the mold unnecessarily which can damage various components of the mold such as the sprue or sprues. The molds transferred by the mold handling system 10 are continuously vertically suspended at all steps of the operation with the acception of the mold movements within either of the first or second grain size sand coating drums 74, 76 or in one of the dryer units 152. Further, by manual entry of data into computer control system 84, an operator can direct access to any individual one of the molds at any stage in mold handling system 10 for example to remove a mold if the mold is damaged. The operator can also input commands to computer control system 84 that indicate the type of mold being entered into mold handling system 10 such that a preprogrammed set of operational steps which are predetermined to optimize the coating and minimize the stay time within mold handling system 10 based on the geometry and type of mold can be used.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An investment casting system, comprising:

a computer controlled mold transfer device operating to move a mold, the mold transfer device movable between at least three stations including:

a mold receiving station;

a mold transfer station having a mold suspended from a first horizontally extending arm of the mold transfer device engaging an intermediate transfer device to transfer the mold to the intermediate transfer device;

a storage station having a storage rack receiving the mold following a material coating phase; and a robot in communication with the intermediate transfer device, the robot programmed to position the mold in any of multiple material coating stations during the material coating phase; and a computer control system operating to automatically identify a location of the mold and to control movement of the mold transfer device, the mold being accessible for removal from the system at any time during creation of the mold by operation of the computer control system.

2. The investment casting system of claim 1, wherein the horizontally extending arm of the mold transfer device includes a hooked end movably positioned below a hanger plate supporting the mold to lift the mold.

3. The investment casting system of claim 1, wherein the storage rack includes a hanger member from which the mold is suspended during temporary storage in the storage station.

4. The investment casting system of claim 1, wherein the material coating phase includes at least a rinse operation, a dip operation, and a sand coating operation.

5. The investment casting system of claim 4, wherein the robot operates to transfer the mold to the intermediate transfer device for subsequent transfer to the mold transfer device and the storage rack after any one or all of the rinse, dip or sand coating operations.

6. The investment casting system of claim 1, wherein the mold temporarily stored in the storage rack is accessed by the mold transfer device at any mold position, and the mold positioned at any of the mold receiving, mold transfer, mold material coating or mold storage stations is accessible at any time.

7. An investment casting system for creating a plurality of investment casting molds, comprising:

a computer controlled mold transfer device including a first horizontally extending arm operating to releasably couple any one of the molds for transfer;

an intermediate transfer device having a second horizontally extending arm, the second horizontally extending arm operating to horizontally transfer any one of the molds to and from a material application section;

a storage section having a plurality of space envelopes individually sized to temporarily store at least one of the molds following any one of a plurality of material coating phases in the material application section, any one of the molds temporarily stored in the storage section being selectively retrievable; and a computer control system to automatically identify a location of any one of the molds in the system and to control movement of the mold transfer device and the intermediate transfer device, any one of the molds being accessible for removal from the system at any stage of completion by direction of the computer control system.

8. The investment casting system of claim 7, wherein individual ones of the space envelopes are uniquely identified in the computer control system for further identifying a period of mold storage in the storage section.

9. The investment casting system of claim 7, further comprising a robot in communication with the intermediate transfer device, the robot programmed to position the mold in any of a plurality of material coating sections during any one of the plurality of material coating phases.

10. The investment casting system of claim 7, further comprising:

a mold receiving section; and a mold transfer section having the mold suspended from the first horizontally extending arm of the mold transfer device engaging the second horizontally extending arm of the intermediate transfer device to transfer the mold to the intermediate transfer device.

11. The investment casting system of claim 7, wherein the storage section further comprises at least first and second humidity controlled ventilation sections, the mold being positioned in one of the plurality of space envelopes of one of the first or second humidity controlled ventilation sections each providing a selectively different drying rate for the mold, a total drying time of the mold predetermined and stored in the computer control system and periodically compared to a drying time at the drying rate.

* * * * *

UNITED STATES PATENT AND TRADEMARK OFFICE

CERTIFICATE OF CORRECTION

PATENT NO. : 8,220,523 B2
APPLICATION NO. : 12/883383
DATED : July 17, 2012
INVENTOR(S) : Anthony F. Morgott et al.

It is certified that error appears in the above-identified patent and that said Letters Patent is hereby corrected as shown below:

Title Page Item [73]
Assignee "Anderson & Associates" should be --Andersen & Associates--

Signed and Sealed this
Fourth Day of September, 2012

David J. Kappos

David J. Kappos
*Director of the United States Patent and Trademark Office*